United States Patent [19]

Miller

[11] Patent Number: 4,696,237

[45] Date of Patent: Sep. 29, 1987

[54] MULTIPLE HOPPER RAIL CAR WITH OFFSET VERTICAL WELD FROM CONVERSION

[75] Inventor: Roy W. Miller, Highland, Ind.

[73] Assignee: Pullman Rail Leasing Incorporated, Chicago, Ill.

[21] Appl. No.: 828,415

[22] Filed: Feb. 11, 1986

[51] Int. Cl.[4] ..... B61D 7/00; B61F 1/08

[52] U.S. Cl. ..... 105/248; 105/404; 105/411; 29/401.1

[58] Field of Search ..... 105/238 R, 239, 247, 105/248, 251, 355, 396, 404, 410, 411, 377, 238.1; 29/401.1; 228/171; 219/137 R

[56] References Cited

U.S. PATENT DOCUMENTS

| | | | |
|---|---|---|---|
| 975,861 | 11/1910 | Harrigan | 105/411 X |
| 3,557,714 | 1/1971 | Aquino et al. | 105/247 X |
| 4,334,481 | 6/1982 | Przybylinski et al. | 105/248 |
| 4,342,146 | 8/1982 | Hanson | 29/401.1 X |
| 4,484,527 | 11/1984 | O'Hara | 105/247 |
| 4,484,528 | 11/1984 | Anderson et al. | 105/248 |
| 4,596,192 | 6/1986 | Forster | 105/397 X |
| 4,605,257 | 8/1986 | Lang et al. | 29/401.1 X |

*Primary Examiner*—Robert B. Reeves
*Assistant Examiner*—Scott H. Werny
*Attorney, Agent, or Firm*—Barry L. Clark

[57] ABSTRACT

A covered, dual hopper car made by converting a rail car having three or more covered hoppers suitable for carrying a large volume of a relatively low density commodity, to a car having a fewer number of hoppers suitable for carrying a smaller volume of a higher density commodity. This is done by internally bracing an interior portion of one end of one hopper end section; severing an unwanted center hopper section from two end hopper sections; removing the unwanted section; and then reassembling and welding the free end sections to each other. The vertical cutting and welding is horizontally offset at the side plate and the sill to provide tab and notch locking arrangements for reinforcement. Preferably, the roof loading hatches are also modified to include downwardly extending collar portions which limit the maximum loading height within the hoppers.

9 Claims, 11 Drawing Figures

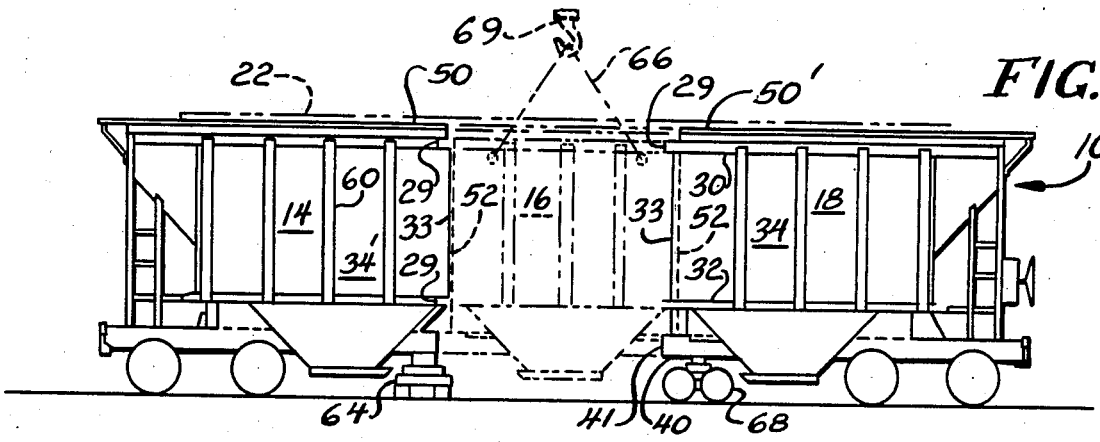
FIG. 1
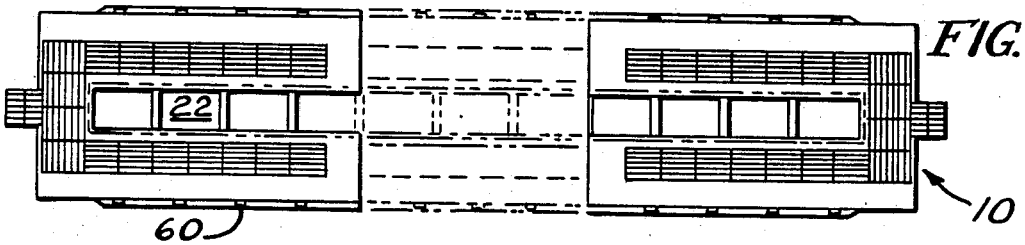
FIG. 2
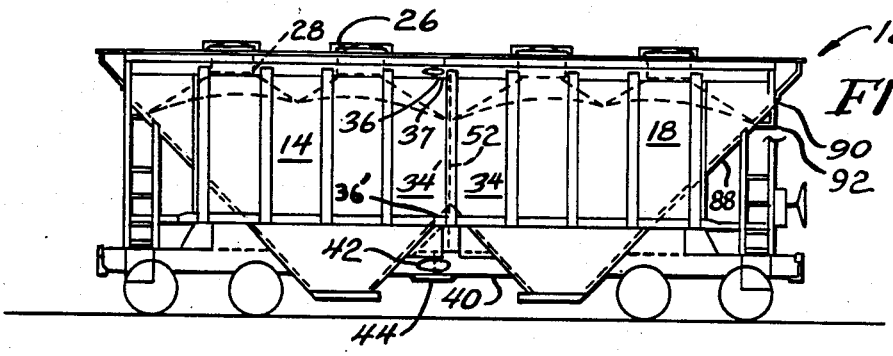
FIG. 3
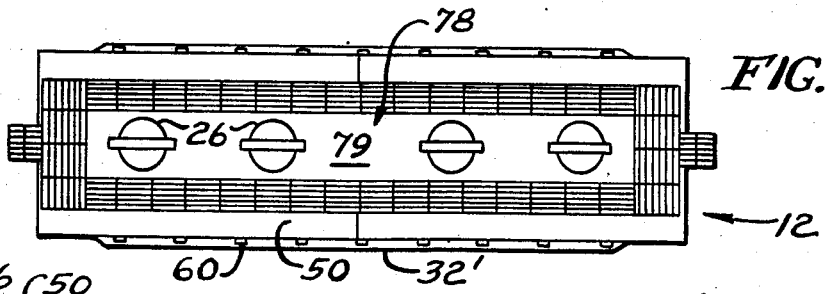
FIG. 4
FIG. 5
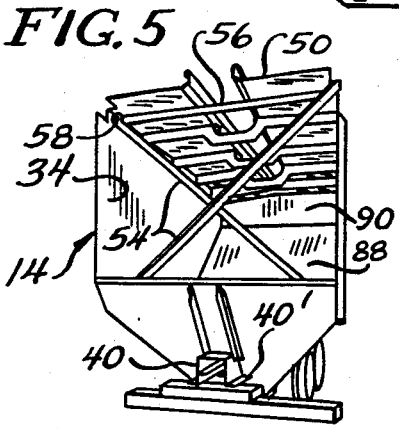
FIG. 6
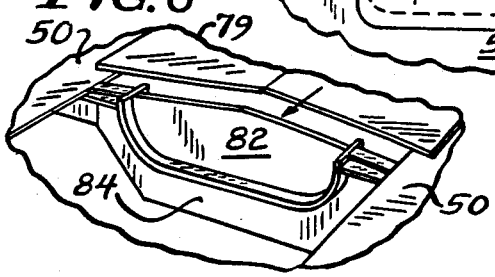
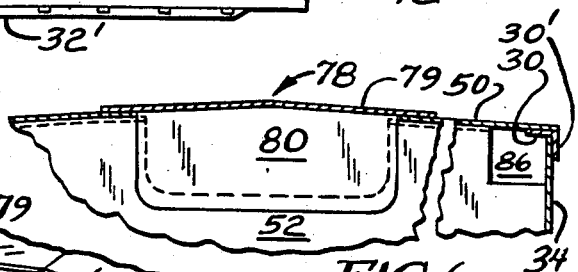
FIG. 6a

MULTIPLE HOPPER RAIL CAR WITH OFFSET VERTICAL WELD FROM CONVERSION

BACKGROUND OF THE INVENTION

The invention relates to rail cars and more particularly to covered multiple hopper cars of the type used to handle bulk shipments of particulate materials. As a general rule, a covered hopper car can be made in a wide range of sizes to accommodate different volumes of materials. However, in the interest of safety and to prevent overloading of tracks and bridges, limits are imposed on the gross loading of a rail car and its contents which is applied to the rails. Limits are also imposed on the overall height of its load in order to keep the car's center of gravity within a prescribed limit.

The density of a particular product to be transported by a rail car can vary widely from low density plastic pellets having a density of about 28 pounds per cubic foot, to grain with a density of about 35 pounds per cubic foot and on to aggregate such as sand, gravel and cement having a density of about 90–100 pounds per cubic foot. To maximize load sizing and the efficiencies of handling, it has been common to build cars for specific commodities so that approximately 100 tons of a particular commodity can be transported in a single car. Thus, for example, one might see four-hopper cars used for handling light products, three-hopper cars used for handling grain and two-hopper cars used for handling cement, sand and gravel. Alternatively, a car can be manufactured which has smaller or larger hoppers, depending upon whether it is being designed to handle a certain weight of a high density material or a low density material. Since a hopper car can have a useful life of 40–50 years, it can and does happen that the existing stock of all types of hopper cars might periodically be out of balance with the current needs of a nation's economy.

At the present time, there is a considerable oversupply of three-hopper grain hauling cars and an undersupply of two-hopper cars for hauling aggregate. Rather than scrapping some of the three-hopper cars and then building new two-hopper cars, it would seem desirable to convert the three-hopper cars to smaller two-hopper cars which would have to be suitable for carrying aggregate.

SUMMARY OF THE INVENTION

It is among the objects of the present invention to provide an improved hopper car and a method of converting a multiple hopper car suitable for carrying commodities of a particular density to a car having at least one less hopper which is suitable for carrying commodities of a greater density. It is another object of the invention to provide a hopper car and a method of converting a multiple hopper car having a relatively high roof suitable for carrying commodities of a particular density to a car having the same height for its roof but a lesser usable internal height dimension which is suitable for carrying commodities of a substantially greater density. A lower internal height is also sometimes required to ensure that the center of gravity of the car will, when fully loaded, remain within an acceptable range. The foregoing and other objects and advantages are achieved by the hopper car and method of the present invention in which a hopper section having one open end and one end closed by a bulkhead is completely severed and removed from a central location intermediate two other hopper sections. The end hopper sections which are located adjacent the removed hopper section are then reassembled and welded together. The end hopper section which originally was joined to the end of the removed hopper section which includes the bulkhead is cross braced prior to severing so that its sheet metal sides will retain their original shape until they are rewelded to the opposite end hopper section. All of the hopper sections are provided with temporary supports prior to severing and the car is preferably leveled before severing. The support for one of the end hopper sections preferably comprises a pair of auxiliary wheels in addition to its normal truck mounted wheels so that clearance can be provided to remove the unwanted center hopper section and so that the two end hopper sections can be easily brought into aligned contact with each other for rewelding. Where the existing hopper loading hatch is of such a height that the hoppers in the converted car would be so high as to permit overloading with a high density commodity, new hatches are provided which include a downwardly extending flange ring to block off an upper portion of the hopper compartment. Every type of material loaded into a hopper through a hatch which is substantially smaller than the hopper will assume a particular angle of repose, such as about 30° for sand and other aggregate. Thus, one can calculate the vertical height which the flange ring must have in order to limit the volume of material which can be loaded into the car. Although many rail cars are loaded while positioned on a scale which permits the loading to be carefully controlled, it would be normal to expect that in loading situations where there is no scale, that the person doing the loading will load to about the top of the hatch. Since such a practice could result in impermissible overloading if the hopper could be completely filled, it is important that the hatch be designed to limit the loading volume.

BRIEF DESCRIPTION OF THE DRAWINGS

FIG. 1 is a side view of a three-hopper rail car with the center hopper section to be removed indicated in phantom;

FIG. 2 is a top view of the three-hopper car of FIG. 1 illustrating its open top loading trough with its covers removed for clarity;

FIG. 3 is a side view of a two-hopper rail car which has been converted from the three hopper arrangement shown in FIG. 1, and to which loading hatches with annular flanges have been added for the purpose of limiting the quantity of a commodity which can be loaded;

FIG. 4 is a top view of the two hopper car of FIG. 3;

FIG. 5 is a perspective view showing how one end of an end hopper is cross-braced prior to being severed from the bulkhead of an adjoining hopper;

FIG. 6 is a perspective view illustrating the roof frame member reinforcements;

FIG. 6*a* shows the center bulkhead closure plate and some added corner support plates;

DETAILED DESCRIPTION OF THE INVENTION

Figure 7:
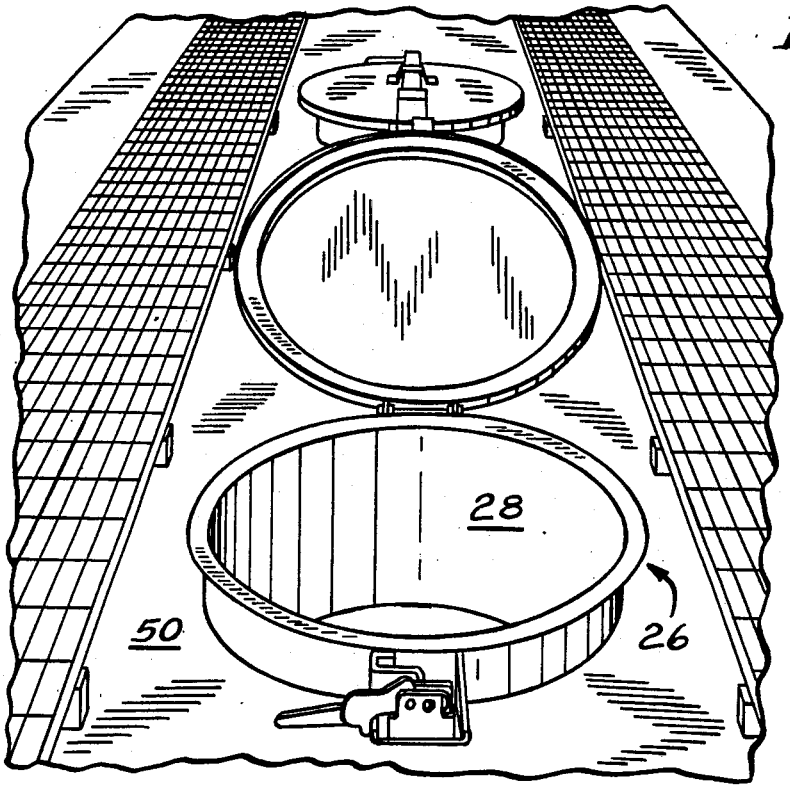
FIG. 7 is a fragmentary perspective view of the top of the car of FIG. 3 showing one hatch in an open position for loading and another hatch closed.
Figure 9A:
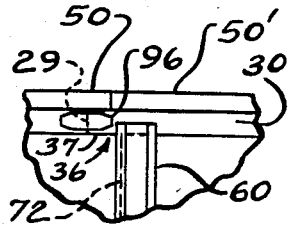
FIG. 9*a* is an enlarged view of an upper portion of FIG. 3 illustrating the reinforcement of the side plate with a splice plate.

FIGS. 1 and 2 illustrate a 4,427 cubic foot capacity covered hopper car indicated generally at 10 which is to be converted in accordance with the method of the present invention into the 3,148 cubic foot capacity car indicated generally at 12 in FIGS. 3 and 4. Basically, the conversion involves severing car 10 into three hopper sections 14, 16 and 18, removing center section 16, which is shown in phantom, and then reassembling and welding end sections 14 and 18 together. It is also preferred that the elongated trough-like loading opening 22 of car 10 be converted to a plurality of round individual loading hatches 26 which have downwardly extending flange ring portions 28 which extend sufficiently far in a downward direction as to limit the height to which a commodity can be loaded in hopper sections 14 or 18.

To insure maximum strength for car 12, the car 10 should be severed very carefully when removing the center hopper section 16. For example, as seen in FIG. 1, the vertical cuts at each end of hopper 16 should not all be in a common vertical line. Rather, the vertical cut lines 29, 29' in the upper side plate 30 and in the lower side sill 32, respectively, should be offset from the cut lines 33 in the side sheet 34 to provide a tab and notch arrangement such as shown at 36 in FIG. 3 which includes horizontal cut lines 37 in addition to the vertical cut lines. The channel-shaped center sill 40 should also have an offset cut line 41 which, after welding, should be reinforced on opposite sides of the channel with a splice plate 42 (FIG. 3) and a backup plate, not shown. Additional splice plates 44 should be welded to the flanged bottom surfaces 40' (FIG. 5) of the center sill 40.

FIG. 5 illustrates the appearance of the inside of the hopper section 14 of FIG. 1 after it has been severed from hopper section 16. To prevent buckling and distortion of the side sheets 34 and roof sheets 50 after they are severed from the bulkhead 52 of hopper section 16, the inside of hopper 14 is reinforced before severing with appropriate cross-bracing. The cross-braces 54 and a horizontal top brace 56 are preferably bolted to each other and to the side and roof sheets by means of brackets 58 which are welded into the four corners of the hopper.

Figure 8:
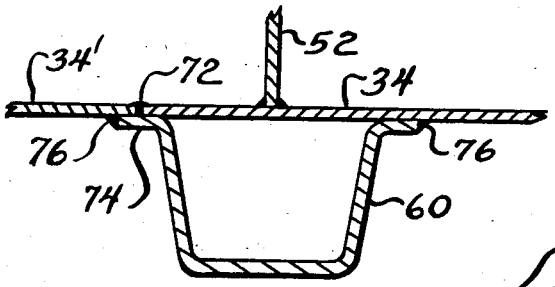
FIG. 8 is a cross-sectional view taken on line 8—8 of FIG. 4.
Figure 9:
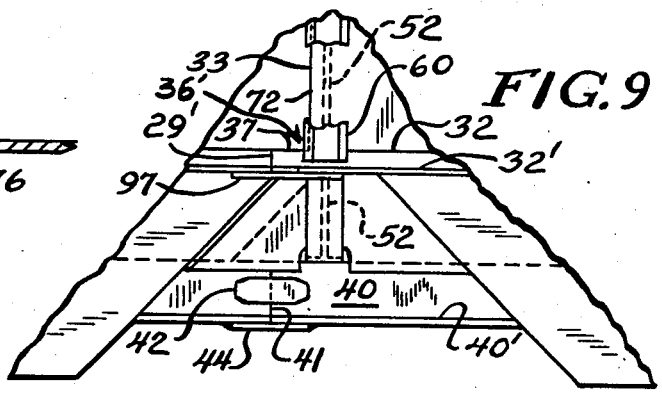
FIG. 9 is an enlarged view of a lower portion of FIG. 3 illustrating the reinforcing of the side sill and center sill frame members with splice plates.

The conversion operation can be generally described as follows: The car 10, as best seen in FIG. 1, is initially leveled and the side posts 60 which cover the bulkhead partitions 52 are removed. Then, temporary supports 64, 66, 68 are provided for each of the sections 14, 16, 18, respectively. The supports 68 under the center sill of section 18 preferably comprise a set of auxiliary wheels so that, after the center hopper section 16 is severed at each of its ends, the end section 18 can be rolled away from it to permit the hook 69 of a crane (not shown) to remove section 16 by lifting support cables 66. The section 18 can then be rolled back on auxiliary wheels 68 and its regular wheels 70 into mating contact with section 14. At this time, turnbuckle assemblies (not shown) can be welded to a pair of side sheets 34, 34' on each side of the car to permit the side sheets to be drawn tightly together and held while they are tack welded to each other. However, the turnbuckles are removed before continuous vertical welds 72 (FIG. 8) are made along lines 33 to join the side sheets 34, 34'. The vertical weld 72 is made from inside the hopper 14 with the weld being backed up by one of the flanges 74 of the side post 60 as best seen in FIG. 8. As previously noted, the particular side posts 60 which cover the bulkhead partitions 52 were removed before the rail car was severed along lines 29, 33, 29' and 37. However, they are rewelded with welds 76 before the vertical weld 72 is made.

The conversion operation continues by welding the roof sheets 50, 50' together to join the roof of hopper section 14 to the roof of hopper section 18. The elongated trough-like loading opening 22 shown in FIGS. 1 and 2 is then cut away from the roof sheets and removed. It is replaced, as can be seen in FIGS. 3 and 4, by the roof hatch assembly 78 which comprises four individual hatch assemblies 26 mounted in a roof plate member 79. The roof plate member 79 is welded to the roof sheets 50 and to a filler plate 80 which is welded so as to close off the top of the central bulkhead 52, as shown in FIG. 6*a*. The roof plate member 79 is also welded to filler plates 82 which, as shown in FIG. 6, fill in the trough-like gaps in the car line assemblies 84 which provide transverse support for the roof above each hopper section.

The hatch assemblies 26 are preferably provided with downwardly extending annular flange rings 28 which, as previously discussed, reduce the volume of material which can be loaded into a hopper by limiting the height to which the material can be loaded to a height which is less than the internal height of the hopper. Since a two-hopper rail car can be loaded with commodities of much greater density than those loaded into a three-hopper car, it is quite likely that additional reinforcement of the hoppers will be necessary when the three-hopper car is converted to being a two-hopper car. Thus, it has been found desirable to reinforce the central bulkhead member 52 by the addition of corner support plates 86 which are welded to the bulkhead 52, roof sheet 50 and side sheets 34. Reinforcement for the slope plates 88 at the ends of the hoppers 14, 18 where they are joined to vertical end plates 90 is also desirable. This latter type of reinforcement is provided by angled brackets 92 (FIG. 3) which can overcome the tendency of heavy loads applied to the slope plates 88 to cause them to tend to bend at their juncture with the end plates 90.

The most important feature of the converted rail hopper car of FIGS. 3 and 4 is its mode of reinforcement which permits the individual hopper sections 14, 18 to support the substantially additional weight of products having a much higher density than those originally contemplated for the car as originally built. The principal reinforcement is provided by offsetting the welds which join hopper 14 to hopper 18. The long vertical weld 72 which joins the cut lines 33 of side sheets 34, 34' stops when it reaches the upper plate 30 and the lower sill 32 and a pair of horizontal continuation welds continue along cut lines 37 for a predetermined distance. Vertical welds then continue along cut lines 29, 29' in the upper side plate 30 and the lower side sill 32 to provide upper and lower tab and notch locking arrangements 36, 36'. The vertical weld 72 and the aligned vertical welds on lines 29, 29' are offset so as to enhance the reinforcement provided thereby. Further support is provided by the fact that the side post 60, which is depicted in FIG. 8 as being welded to both of the side sheets 34, 34', is also used as a backup for the weld 72. Additional reinforcement is provided by the welded splice plates 96 which overlie the welded cut lines 29 on the vertical flange 30' of the angled side plates 30, and the welded splice plates 97 which underlie the cut line 29' on the outwardly directed horizontal flange 32' of the angled side sill 32. The splice plates 96 are spaced to one side of the side post 60 and thus, can be readily inspected for the integrity of their welds. Finally, the previously mentioned splice plates 42, 44 reinforce the center sill member 40 in the region of its welded cut line 41.

I claim:

1. A covered, dual hopper rail car having its two hopper sections joined by a common transverse central bulkhead, said hopper sections each having side portions formed by metal side sheets with the top and bottom portions of said side sheets being reinforced by an upper side plate and a lower side sill, respectively, said rail car being characterized in that said side sheets adjacent said transverse central bulkhead include a weld joint which has a first elongated intermediate portion which extends vertically in a first line between said upper side plate and said lower side sill, a pair of end portions which extend vertically in a pair of vertically spaced apart second lines which are also spaced from, and parallel to, said first line, said end portions extending only in the region of said upper side plate and said lower side sill, and a pair of horizontal portions extending along a third pair of lines which join each end of said intermediate portion to one of said end portions, said weld joint serving to reinforce and bond together the end hopper sections of a three hopper rail car from which the center hopper section was previously removed by being cut along said first, second and third lines.

2. The rail car of claim 1 wherein a vertical side post having a generally U-shaped horizontal cross-section is welded to each of said side sheets so as to overlie both a side edge of said transverse central bulkhead and also said intermediate portion of said weld joint.

3. The rail car of claim 2 wherein said vertical side posts have outwardly extending flanges at the ends of the legs of the "U" which lie in a common plane, one of said flanges being located immediately over said first line and defining a backup plate support for said intermediate portion of said weld joint which is integrally joined thereto.

4. The rail car of claim 3 wherein said pair of second lines defining said pair of end portions of said weld joint are horizontally spaced from said side posts and at least said weld on said pair of second lines on said side plate is reinforced by an overlying splice plate which extends fore and aft thereof in a vertical plane, said side sill being reinforced by a splice plate which underlies a horizontal flange portion thereof.

5. The rail car of claim 4 wherein at least the end portions of said weld joints are spaced sufficiently far from said intermediate portions and from said side posts that said overlying splice plate which reinforces said weld joint on said side plate will be fully accessible for inspection.

6. The rail car of claim 5 wherein said rail car is supported by a center sill which includes a vertical weld joint which is generally aligned with said second lines, said weld joint on said center sill being reinforced by splice plates on the underneath surfaces of the center sill as well as on the outer side surfaces of the center sill.

7. The rail car of claim 1 wherein said dual hopper rail car is covered by a roof in which at least a pair of covered circular hatches are mounted for each of the two hoppers to permit loading of various materials into said hoppers, said hatches being characterized in that they include downwardly extending annular flanges which project into said hoppers to limit the height of which materials can be loaded into said hoppers in the interior regions surrounding the hatches to a height less than the height of the hopper roof, the vertical height of said annular flanges being selected to be of a sufficient height which will, for a particular material with which it is adapted to be filled, prevent said rail car from being overloaded and will also prevent the center of gravity of the loaded rail car from exceeding its allowable limit.

8. The rail car of claim 1 wherein said transverse central bulkhead has corner support plates welded to itself and to the roof and side sheets at the upper corners thereof for increasing the thickness of said bulkhead in its upper corners, said corner support plates serving to increase the ability of said central bulkhead to resist the forces applied thereto when one hopper section is loaded to a greater extent than the other hopper section.

9. The rail car of claim 1 wherein the end walls of said hopper sections which are located at the ends of said rail car each have a vertical cross-section in the plane of the axis of the rail car which includes a vertical wall portion which extends vertically downwardly from the roof of the rail car and a sloping wall portion which slopes downwardly and inwardly in a converging direction toward the other end wall, said end walls having angle bracket support members welded thereto at the juncture of the sloped portions thereof with the vertical portions and at a portion of the sloped portions positioned below said juncture, said angle bracket support members serving to strengthen said end walls and permit them to support substantial pressures from materials in said hoppers without changing the shape of said vertical cross-section.

* * * * *